US011713175B2

(12) United States Patent
Andre et al.

(10) Patent No.: US 11,713,175 B2
(45) Date of Patent: Aug. 1, 2023

(54) PACKAGING

(71) Applicant: Apple Inc., Cupertino, CA (US)

(72) Inventors: Bartley K Andre, Menlo Park, CA (US); Daniel J. Coster, San Francisco, CA (US); Daniele De Iuliis, San Francisco, CA (US); Richard P. Howarth, San Francisco, CA (US); Jonathan P. Ive, San Francisco, CA (US); Steve P. Jobs, Palo Alto, CA (US); Duncan Robert Kerr, San Francisco, CA (US); Shin Nishibori, Kailua, HI (US); Matthew Dean Rohrbach, San Francisco, CA (US); Peter Russell-Clarke, San Francisco, CA (US); Douglas B. Satzger, Menlo Park, CA (US); Calvin Q. Seid, Palo Alto, CA (US); Christopher J. Stringer, Woodside, CA (US); Eugene Antony Whang, San Francisco, CA (US); Rico Zorkendorfer, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 973 days.

(21) Appl. No.: 15/482,497

(22) Filed: Apr. 7, 2017

(65) Prior Publication Data

US 2017/0210535 A1 Jul. 27, 2017

Related U.S. Application Data

(60) Continuation of application No. 13/007,292, filed on Jan. 14, 2011, now abandoned, which is a (Continued)

(51) Int. Cl.
*B65D 77/26* (2006.01)
*B65D 25/10* (2006.01)
(Continued)

(52) U.S. Cl.
CPC ..... *B65D 77/26* (2013.01); *B65D 25/10* (2013.01); *B65D 25/54* (2013.01); *B65D 77/20* (2013.01);
(Continued)

(58) Field of Classification Search
CPC ..... B65D 25/10; B65D 77/26; B65D 25/107; B65D 25/108; B65D 75/325; B65D 81/1075; H04R 1/1016; H04R 1/02
See application file for complete search history.

(56) References Cited

U.S. PATENT DOCUMENTS 1,315,593 A 9/1919 Binder
1,518,219 A 12/1924 Peter
(Continued)

FOREIGN PATENT DOCUMENTS

EM 546403-0001 8/2006
JP 61-40925 3/1986
(Continued)

*Primary Examiner* — Anthony D Stashick
*Assistant Examiner* — Blaine G Neway
(74) *Attorney, Agent, or Firm* — Sterne, Kessler, Goldstein & Fox P.L.L.C.

(57) ABSTRACT

Packaging comprising a base having an interior space for receiving an item, wherein the base includes a bottom surface and one or more side surfaces; a ledge formed along a side surface; and a holder supported by the ledge, wherein the holder includes a retaining mechanism for retaining the item.

19 Claims, 12 Drawing Sheets

Related U.S. Application Data continuation-in-part of application No. 29/364,391, filed on Jun. 23, 2010, now Pat. No. Des. 635,853, which is a continuation of application No. 29/284,343, filed on Sep. 5, 2007, now Pat. No. Des. 621,256, said application No. 13/007,292 is a division of application No. 11/849,176, filed on Aug. 31, 2007, now Pat. No. 7,878,326, which is a continuation-in-part of application No. 29/281,505, filed on Jun. 25, 2007, now Pat. No. Des. 596,485, and a continuation-in-part of application No. 29/265,952, filed on Sep. 11, 2006, now Pat. No. Des. 558,572, and a continuation of application No. 29/265,951, filed on Sep. 11, 2006, now Pat. No. Des. 558,571.

(51) Int. Cl.
*B65D 25/54* (2006.01)
*B65D 77/20* (2006.01)
*H04R 1/10* (2006.01)

(52) U.S. Cl.
CPC ..... *H04R 1/1016* (2013.01); *H04R 1/1091* (2013.01)

(56) References Cited

U.S. PATENT DOCUMENTS 1,650,039 A 11/1927 Price
D111,649 S 10/1938 Domenico
D114,891 S 5/1939 Fogel
2,310,641 A * 2/1943 Lux ..... A47F 7/03 206/45.2
2,316,384 A 4/1943 Abramson
2,606,708 A 8/1952 Irvan
2,722,719 A 11/1955 Altstadter
3,401,535 A 9/1968 Palmer
3,463,309 A 8/1969 Szostek
3,487,921 A 1/1970 Barth et al.
3,850,333 A 11/1974 Reichert
D246,439 S 11/1977 Lynn et al.
4,085,845 A 4/1978 Perfect
D248,621 S 7/1978 Hay et al.
4,106,597 A 8/1978 Shook et al.
4,293,074 A 10/1981 Dunsky
D280,290 S 8/1985 Bakus
4,542,822 A 9/1985 Kennedy, Jr. et al.
4,606,459 A 8/1986 Luray
4,606,460 A 8/1986 Luray
4,739,353 A 4/1988 Heuer et al.
4,804,984 A * 2/1989 Heuer ..... B65D 75/32 206/316.2
4,876,136 A 10/1989 Chang et al.
4,953,705 A 9/1990 Evamy
D312,358 S 11/1990 Horne
5,040,678 A 8/1991 Lenmark, Sr. et al.
5,092,354 A 3/1992 Pacelli, Jr.
5,105,941 A 4/1992 Dolan et al.
D331,191 S 11/1992 Ventola et al.
5,251,760 A 10/1993 Smith et al.
5,295,580 A 3/1994 Hicks
5,339,461 A * 8/1994 Luplow ..... H04B 1/086 242/385
5,484,063 A 1/1996 Cuccio et al.
D369,295 S 4/1996 Kobari et al.
D369,469 S 5/1996 Gregory
5,573,119 A 11/1996 Luray
D382,735 S 8/1997 Zapf
D385,156 S 10/1997 Bouldstridge Balari
5,694,744 A 12/1997 Jones
D396,154 S 7/1998 Matthews
D397,552 S 9/1998 Rutledge
D406,463 S 3/1999 Rutledge
5,893,462 A 4/1999 Ridgeway
D411,448 S 6/1999 Baker
5,967,327 A 10/1999 Jones
D417,391 S 12/1999 Szczepanski et al.
6,010,006 A 1/2000 Ridgeway et al.
6,154,360 A 11/2000 Kaczeus, Sr. et al.
6,241,090 B1 6/2001 Kaplinsky
6,302,274 B1 10/2001 Ridgeway
6,305,539 B1 10/2001 Sanders, Jr.
6,367,624 B1 4/2002 Szczepanski et al.
6,400,247 B1 6/2002 King
D490,977 S 6/2004 Freeman
6,889,839 B1 5/2005 Rosten et al.
D506,744 S * 6/2005 Andre ..... D14/205
6,920,981 B2 7/2005 Lofgren et al.
7,086,534 B2 8/2006 Roesel et al.
7,117,993 B2 10/2006 Koike
D541,045 S 4/2007 Peart et al.
7,296,681 B2 11/2007 McDonald et al.
D558,571 S 1/2008 Andre et al.
D558,572 S 1/2008 Andre et al.
D558,756 S 1/2008 Andre et al.
D558,757 S 1/2008 Andre et al.
D558,758 S 1/2008 Andre et al.
D579,923 S 11/2008 Andre et al.
D580,387 S 11/2008 Andre et al.
D580,752 S 11/2008 Andre et al.
D582,267 S 12/2008 Andre et al.
D584,142 S 1/2009 Andre et al.
7,494,015 B2 2/2009 Bacon et al.
7,506,758 B2 3/2009 Davis-Garrison
7,520,389 B2 4/2009 Lalouette
D596,485 S 7/2009 Andre et al.
D604,501 S * 11/2009 Lee ..... D3/201
D607,317 S 1/2010 Collins
D616,741 S 6/2010 Andre et al.
D618,204 S 6/2010 Andre et al.
D620,795 S 8/2010 Andre et al.
D621,256 S 8/2010 Andre et al.
D624,406 S 9/2010 Cronican et al.
D633,388 S 3/2011 Andre et al.
D635,455 S 4/2011 Andre et al.
D672,660 S * 12/2012 Vural ..... D9/721
D685,771 S * 7/2013 Bertenthal ..... D14/223
D706,643 S * 6/2014 Akana ..... D9/432
D709,384 S * 7/2014 Vural ..... D9/721
D709,385 S * 7/2014 Vural ..... D9/721
D722,264 S * 2/2015 Saideh ..... D9/418
2006/0266672 A1 11/2006 Young
2008/0169218 A1 7/2008 Andre et al.

FOREIGN PATENT DOCUMENTS

JP D1066280 4/2000
JP D1079431 7/2000
JP 2001000226 A * 1/2001
KR 30-0253042 2/2000
KR 30-0267299 12/2000
KR 30-0426293 3/2006
TW D105819 8/2005

* cited by examiner

PACKAGING

CROSS REFERENCE TO RELATED APPLICATIONS

This application is a continuation of U.S. patent application Ser. No. 13/007,292, filed on Jan. 14, 2011, which is a divisional of U.S. patent application Ser. No. 11/849,176 filed Aug. 31, 2007, and a continuation of U.S. Application Ser. No. 29/364,391, filed Jun. 23, 2010; U.S. Application Ser. No. 11/849,176 is a continuation-in-part of U.S. patent application Ser. No. 29/281,505 filed Jun. 25, 2007; U.S. Patent application Ser. No. 11/849,176 is also a continuation-in-part of U.S. patent application Ser. No. 29/265,951 filed Sep. 11, 2006; U.S. application Ser. No. 11/849,176 is also a continuation-in-part of U.S. patent application Ser. No. 29/265,952 filed Sep. 11, 2006; U.S. application Ser. No. 29/364,391 is a continuation of U.S. application Ser. No. 29/284,343, filed Sep. 5, 2007, the disclosures of which are all incorporated herein, in their entirety, by reference thereto.

The disclosures of U.S. patent application Ser. No. 29/281,648 filed Jun. 27, 2007, U.S. patent application Ser. No. 29/270,880 filed Jan. 5, 2007, U.S. patent application Ser. No. 29/270,881 filed Jan. 5, 2007, U.S. patent application Ser. No. 29/270,885 filed Jan. 5, 2007, U.S. patent application Ser. No. 29/270,887 filed Jan. 5, 2007, and U.S. patent application Ser. No. 29/270,888 filed Jan. 5, 2007 are also incorporated herein, in their entirety, by reference thereto.

BACKGROUND OF THE INVENTION

Field of the Invention

The present invention generally relates to packaging, and more particularly, to packaging for an article of manufacture.

Background Art

The main purpose of packaging is to protect the product during shipment and merchandising. However, as a marketplace becomes more competitive, it becomes desirable for packaging to be interesting and to attract consumers to a product either in advertising or in product placement on retail shelves. The packaging may be the first thing a potential consumer sees when they first encounter a product. Therefore, packaging may be an important tool used to generate consumer interest and to project the image and brand of the company who produces the product.

Branding can be particularly important in the highly competitive marketplace of consumer electronics, for example portable, handheld electronic devices. Consumers of such devices tend to be discriminating and savvy. As a result, competition for their loyalty is fierce. For example, consumers have become familiar with the clean, minimalist appearance of the iPod® media players manufactured by Apple Inc. of Cupertino Calif. The iPod® media player is also known for its elegant, yet simple design. It may diminish from the aura of such a well designed product to present it to consumers in a standard cardboard box. A package that is more fitting of the high-tech design of the product is what consumers have come to expect.

BRIEF SUMMARY OF THE INVENTION

The present invention relates, in one embodiment, to packaging comprising a base having an interior space for receiving an item, wherein the base includes a bottom surface and one or more side surfaces; a ledge formed along a side surface; and a holder supported by the ledge, wherein the holder includes a retaining mechanism for retaining the item.

BRIEF DESCRIPTION OF THE DRAWINGS/FIGURES

The present invention is illustrated by way of example, and not by way of limitation, in the figures of the accompanying drawings and in which like reference numerals refer to similar elements and in which.

DETAILED DESCRIPTION OF THE INVENTION

The present invention will now be described in detail with reference to a few preferred embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps have not been described in detail in order not to unnecessarily obscure the present invention.

Figure 1:
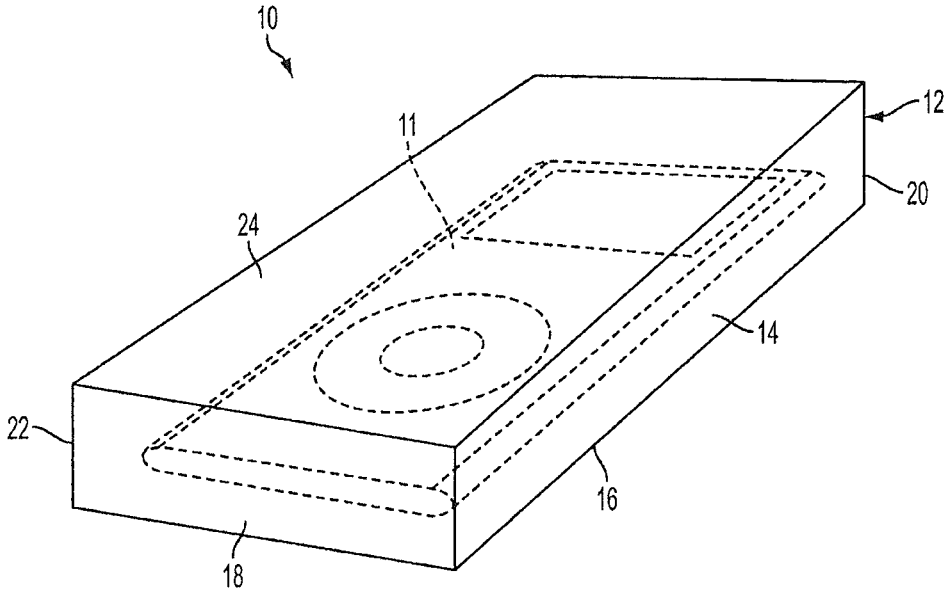
FIG. 1 is a perspective view of packaging according to the present invention.

FIG. 1 is a diagram of device packaging shown generally at 10, in accordance with one embodiment of the present invention. Device packaging 10 includes an enclosure 12 that is configured to retain a device 11 (shown in phantom) therein for presentation purposes. Enclosure 12 generally forms an internal cavity for internal placement of device 11. In one embodiment, device packaging 10 is configured to suspend internally positioned device 11 between one or more walls of enclosure 12. This may, for example, give the appearance that device 11 is floating within the cavity. Various retention mechanisms such as bars, frames, trays, and the like may be used to suspend a device in enclosure 12.

The shape of enclosure 12 may be widely varied. It may, for example, be rectilinear, curvilinear, or a combination of the two. In the illustrated embodiment, device packaging 10 is somewhat box-like such that it includes six walls: a top wall 24 and an opposing bottom wall 16; a front wall 18 and an opposing back wall 20; a right side wall 14 and an opposing left side wall 22. Of course, this is not a limitation. For example, enclosure 12 may have a more complex shape such as a cylinder or uncommon shape for packaging, such as an apple, for example.

The size of enclosure 12 may also be widely varied. By way of example but not limitation, it may be sized to enclose portable handheld electronic devices. For example, enclosure 12 may be sized to enclose items much larger or much smaller than portable handheld electronic devices.

In one embodiment, enclosure 12 generally follows the form of device 11. For example, the spacing between device 11 and the walls of enclosure 12 is substantially similar around the entire periphery of device 11, such that device 11 is substantially uniformly placed inside enclosure 12.

The various walls may be opaque, transparent, or semitransparent. In one embodiment, at least a portion of the front, for example front wall 18 of device packaging 10 is made semitransparent or transparent so that a portion or the entire front of the device may be seen through device packaging 10. In another embodiment, at least a portion of the front, for example front wall 18 of device packaging 10 as well as at least a portion of top wall 24, bottom wall 16, or side walls 14 and 22 are made semitransparent or transparent so that a portion or the entire front and side of device 11 may be seen. In another embodiment, all the walls of device packaging 10 are made semitransparent or transparent.

Device packaging enclosure 12 may be integrally formed as a single piece or formed as multiple pieces that are assembled together. By way of example, device packing enclosure 12 may include a top portion and a bottom portion that fit together to form the entire enclosure. The interface may be configured for a snug fit. In some cases, the interface may be designed to have the outer surface of both portions flush when placed together.

Device packaging enclosure 12 may additionally include therein other components of device 11, for example accessories used with device 11. The accessories may be placed in an internal box (not shown) inside enclosure 12, which can be opaque, semitransparent or transparent.

Figure 2A:
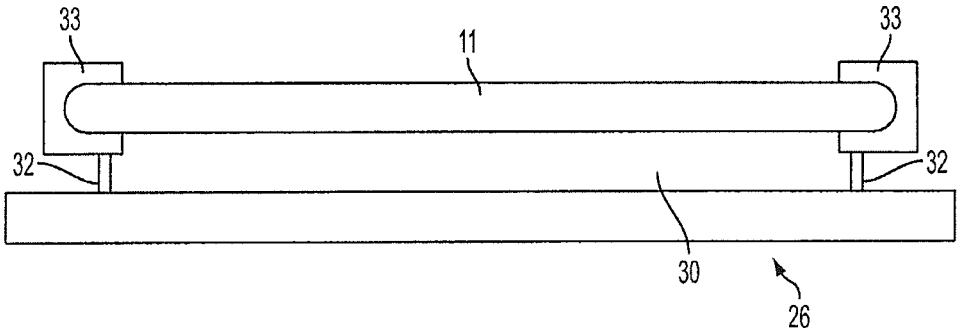
FIG. 2A is a side view of a tray or holder used in the packaging of FIG. 1.
Figure 2B:
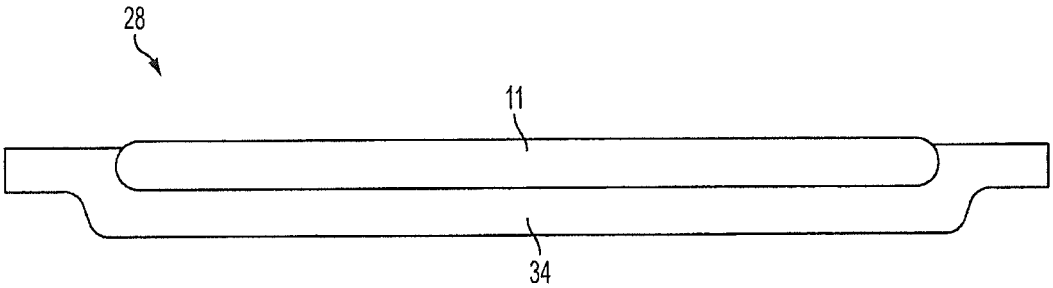
FIG. 2B is a side view of another embodiment of a tray or holder used in the packaging of FIG. 1.

As shown in FIGS. 2A and 2B, device 11 may be supported inside enclosure 12 by a holder or tray (26 in FIG. 2A and 28 in FIG. 2B). In one embodiment, as shown in FIG. 2A, tray 26 may support device 11 in a raised position such that gap 30 is provided between the top surface of tray 26 and the bottom surface of device 11. Tray 26 may, for example, include one or more retention arms 32 disposed between tray 26 and device 11. Retention arm(s) 32 may be placed at a variety of locations along an axis, for example the longitudinal axis, of device 11. For example, retention arm(s) 32 may be placed at the ends, in the middle, or at intermediate positions along an axis of device 11. In the illustrated embodiment, a pair of retention arms 32 are placed at opposing ends of device 11. Retention arms 32 are typically configured to secure device 11 in its desired position relative to tray 26.

Retention arms 32 may include retention feature 33. Retention feature 33 may be widely varied; for example, retention feature 33 may include detents, slots, latches, tabs, snaps or the like. In one implementation, retention feature 33 is enabled by a flexing action of retention arms 32, or tray 26, or both. The flexing action allows tray 26 to be configured for capturing and releasing device 11. By way of example, retention arms 32 may flex by bending relative to tray 26 and/or tray 26 may flex by bending. Tray 26 may flex by bending outwardly relative to device 11 to capture/release device 11 and by bending inwardly relative to device 11 to secure device 11 therein. By way of example, tray 26 and/or retention arms 32 may be bent open thus releasing/receiving device 11, and bent closed thus capturing/retaining device 11 therein. When tray 26 and/or retention arms 32 are bent closed, device 11 is trapped between retention arms 32. Put another way, retaining arm(s) 32 may be fixed while tray 26 is flexible and/or tray 26 may be fixed while retaining arm(s) 32 are flexible, or a combination of both.

In another embodiment, as shown in FIG. 2B, tray 28 includes a recessed portion, void, or cavity 34, in which device 11 rests. Recessed portion, void, or cavity 34 may, for example, be formed to match the outer shape of device 11. In one example, recessed portion, void, or cavity 34 is configured to receive a bottom portion of device 11 therein, for example substantially the bottom half of device 11.

In both embodiments of FIG. 2, they trays may be supported internally within enclosure 12 by various means, for example, flanges, ladders, legs, ledges, rims, tabs/slots, or the like. In one example, the trays are supported by an internal ledge that is disposed around the perimeter of the inside surface of the top, bottom, and/or side walls of device packaging 10.

Figure 3:
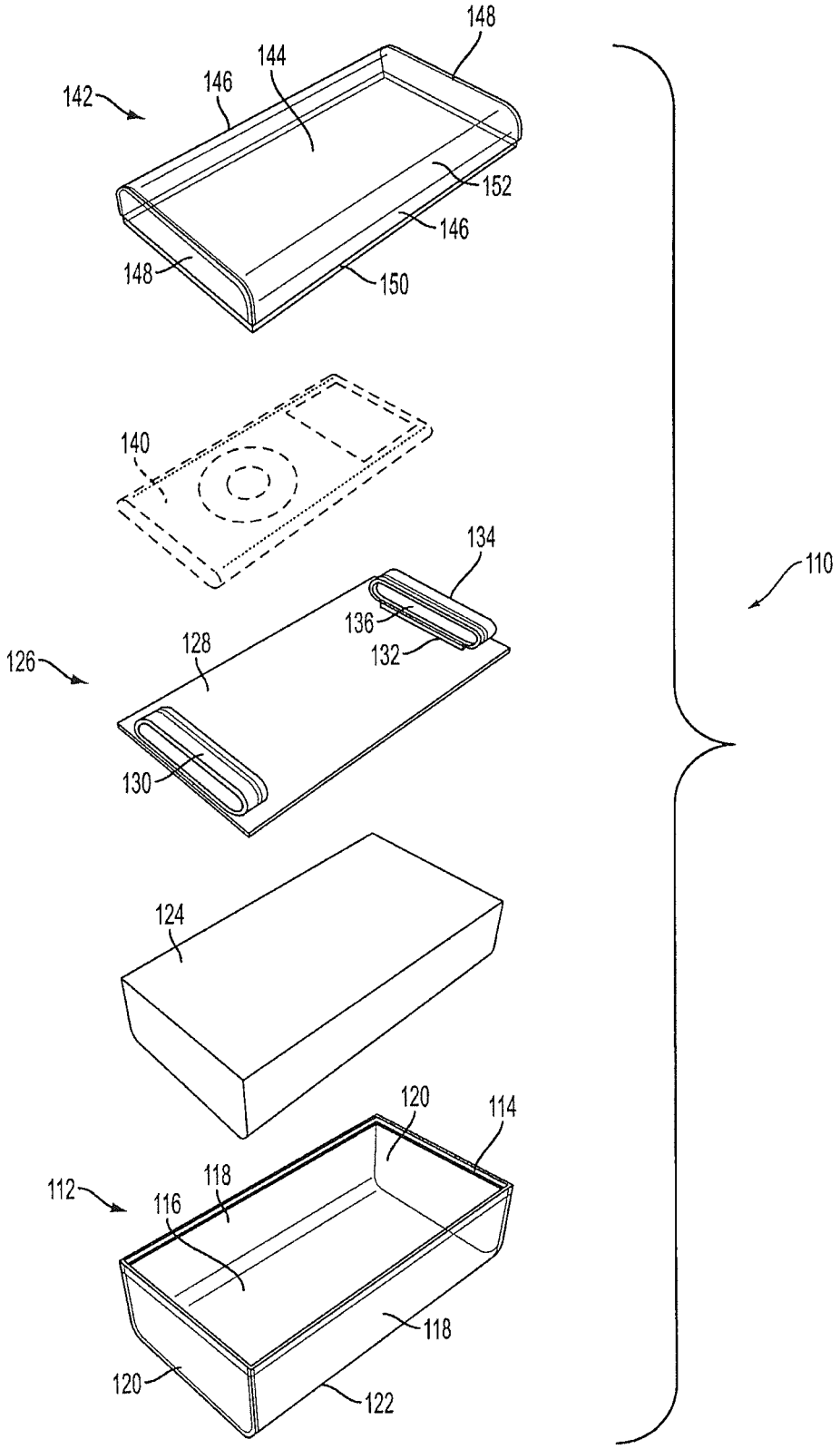
FIG. 3 is an exploded perspective view of another embodiment of packaging according to the present invention.

Another embodiment of the present invention comprises packaging, shown generally at 110 in FIGS. 3 and 4, which is comprised primarily of a base 112, a holder 126 and a lid 142, each of which will now be described in more detail. Base 112 comprises bottom wall 116, two lengthwise parallel vertical side walls 118, and two widthwise parallel vertical side walls 120 joined to bottom wall 116 to create a generally rectangular box shape forming an interior space for receiving an article to be placed in packaging 110. Base 112 can be made of transparent material to give it a modern feel. In one embodiment, the transparent material can be plastic. To give packaging 110 a more aesthetically-pleasing look, bottom wall 116 and side walls 118 may be formed as one piece, and the area 122 where bottom wall 116 meets side walls 118 may be curved. A ledge 114 is formed along the interior surface of walls 118 and 120, to support holder 126, as described in more detail below.

An insert 124 may be placed in the interior of base 112 and may be marked with identifying words or pictures to convey information to the consumer about the product inside packaging 110. Additionally, accessory items (not shown) for use with a product contained in packaging 110 can be stored inside insert 124. For example, -power cords, earphones, USB connectors, and the like, or warranties and instruction manuals can be stored inside insert 124. Insert 124 may be shaped to conform to the shape of base 112 and is sized to fit snugly in the interior of base 112. In one embodiment, insert 124 can be opaque so that any items stored within are not visible when inside packaging 110. When insert 124 is opaque, for example white, and is inserted inside of a transparent base 112, it gives packaging 110 a "glossy" look and may additionally create the appearance that insert 124 is formed on the interior surface or is "embedded" inside base 112.

Resting above insert 124, and supported by ledge 114, is holder 126, which holds the product within packaging 110. Holder 126 includes a horizontal tray 128 which can be made of the same transparent material from which base 112 is made. In one embodiment, the transparent material can be plastic. Tray 128 can be rectangular shaped to fit within the interior space created by walls 116 and 118 of base 112. Tray 128 can take other shapes, which mimic the shape of base 112. Holder 126 has a pair of vertically disposed clips 130 extending upwardly from opposite ends of tray 128 to support an item within packaging 110. Each clip 130 may be made of the same material as is tray 128 and is comprised of a bar 134 suspended by a spacer 132 above the top surface of tray 128. Each bar 134 has an indented surface 136, which may be shaped to fit the profile of a product 140 contained in packaging 110 (shown in phantom in FIGS. 3 and 4). Item 140 can be trapped and released between the pair of bars 134. This trapping is accomplished by flexing either tray 128 and/or clips 130 to cause clips 130 to come further apart so that item 140 can be received there between in a spring loaded fashion. In order to release item 140, tray 128 and/or clips 130 can again be flexed outward and item 140 can be grasped by the user and released. While clips 130 are shown along the width of tray 128, they may alternatively be placed along the length thereof or both the length and width.

Spacer 132 suspends item 140 above the top surface of holder 126, giving the appearance that item 140 is unsupported and is "floating" inside packaging 110. By way of example and not limitation, item 140 may be an iPod® nano® media player. The iPod® nano® media player is a flash MP3 player produced by Apple Inc. It weighs 1.5 ounces and it is 3.5 inches high, 1.6 inches wide, and 0.27 inches deep. Item 140 can vary widely in size, shape, and weight.

Figure 7:
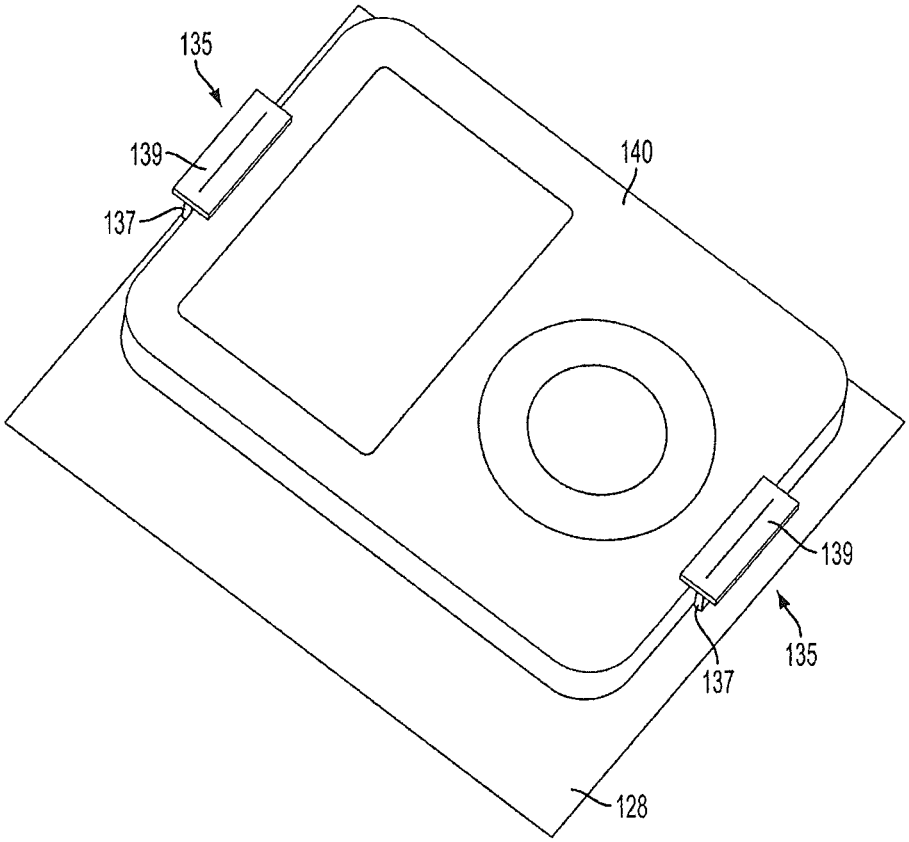
FIG. 7 is a perspective view of another embodiment of a holder which may be used in the packaging of FIGS. 3 and 4.
Figure 8:
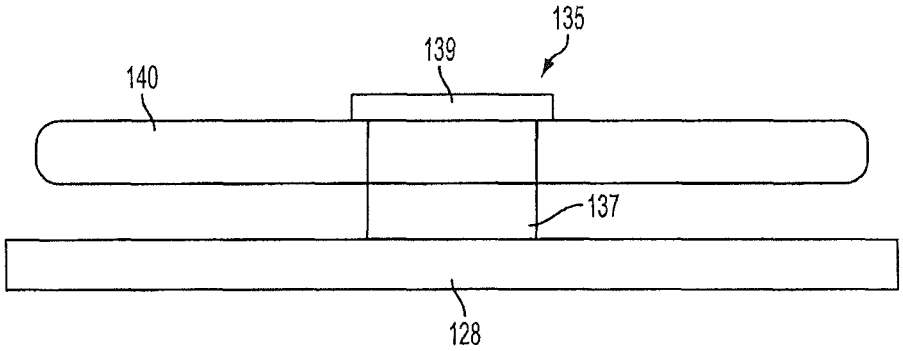
FIG. 8 is a side view of the holder of FIG. 7.

Alternate clips 135, as best seen in FIGS. 7 and 8, can also be used. In this embodiment, clips 135 are T-shaped and comprise a spacer element 137 and a locking bar 139. Spacer 137 extends generally vertically, and locking bar 139 extends generally horizontally, giving clip 135 a T-shape. Locking bar 139 extends over a portion of the width of item 140 to trap it between tray 128 and locking bar 139. Similar to the embodiment using clips 130, this trapping is accomplished by flexing either of tray 128 and/or clips 135 outward to receive item 140, and then releasing either of tray 128 and/or clips 135 to retain item 140 in a spring-loaded fashion. In order to release item 140, tray 128 and/or clips 135 can again be flexed outward and item 140 can be grasped by the user and released. While clips 135 are shown along the width of tray 128, they may alternatively be placed along the length thereof or both the length and width. They may also be L-shaped instead of T-shaped, or various other shapes that will function to hold an item 140 between them in the manner described herein.

Lid 142 forms the top of packaging 110. In one embodiment, lid 142 can be made of the same transparent material from which base 112 and holder 126 are made. In one embodiment, the transparent material can be plastic. Lid 142 comprises a top wall 144 joined along its periphery to two lengthwise parallel vertical walls 146, and two widthwise parallel vertical walls 148 creating a generally rectangular shape similar to base 112. To give packaging 110 a more aesthetically-pleasing look, top wall 144 and side walls 146 may be formed as one piece, and the area 152 where the top wall 144 meets the side walls 146 may be curved. Lid 142 has an indented lower rim 150 along its outer periphery which is shaped to fit snugly inside base 112, and to mate with ledge 114 on the interior surface of walls 118 and 120 above ledge 114 on base 112 to form a flush juncture 154 between lid 142 and base 112, which is best seen in FIG. 4. Rim 150 may be formed along the entire circumference of lid 142.

Figure 4:
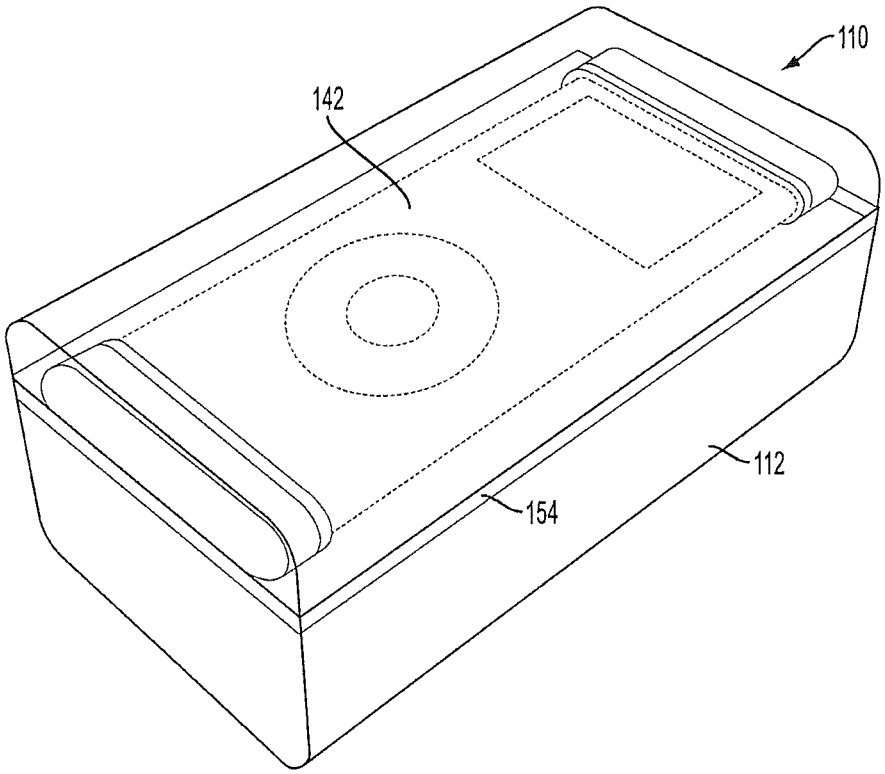
FIG. 4 is a perspective view of the packaging of FIG. 3.
Figure 5:
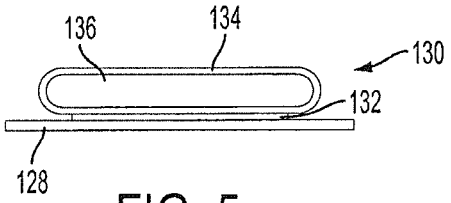
FIG. 5 is a is a top view of a holder used in the packaging of FIGS. 3 and 4.
Figure 6:
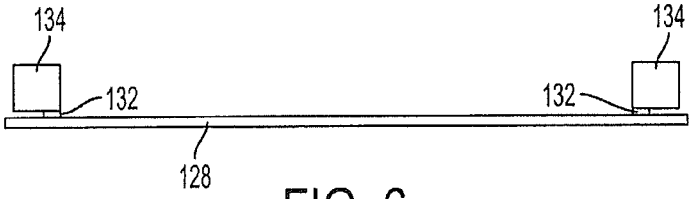
FIG. 6 is a is a side view of the holder of FIG. 5.

The unique "floating" effect of the present invention is best seen in FIG. 4. When item 140 is placed on tray 128 of holder 126, it is trapped and suspended by clips 130. Because base 112, lid 142, and holder 126 are all transparent, it creates the illusion that item 140 is floating within packaging 110. The "floating" effect may be further enhanced by giving packaging 110 a glossy appearance to make packaging 110 visually striking to the consumer.

Figure 9:
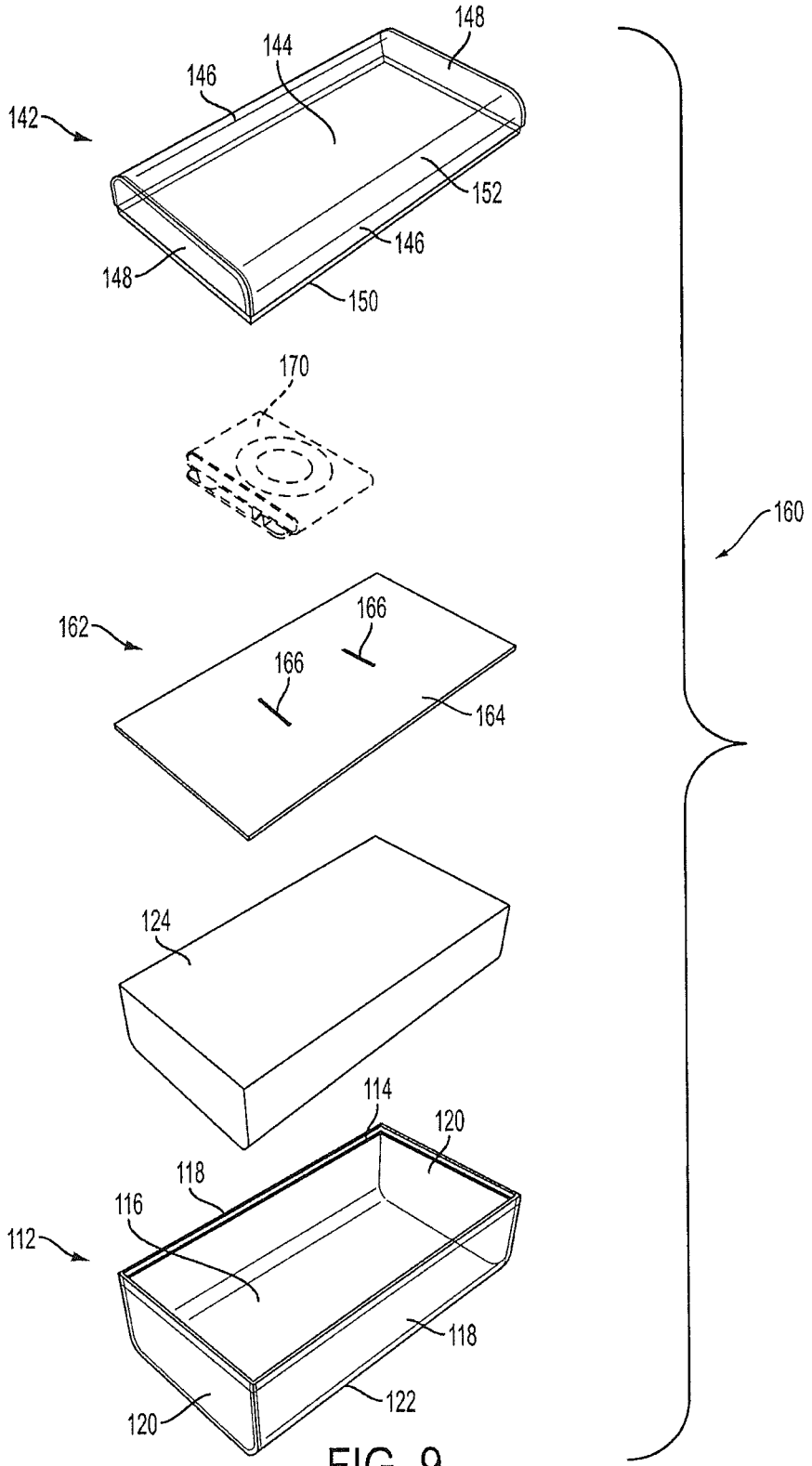
FIG. 9 is an exploded perspective view of another embodiment of packaging according to the present invention.
Figure 10:
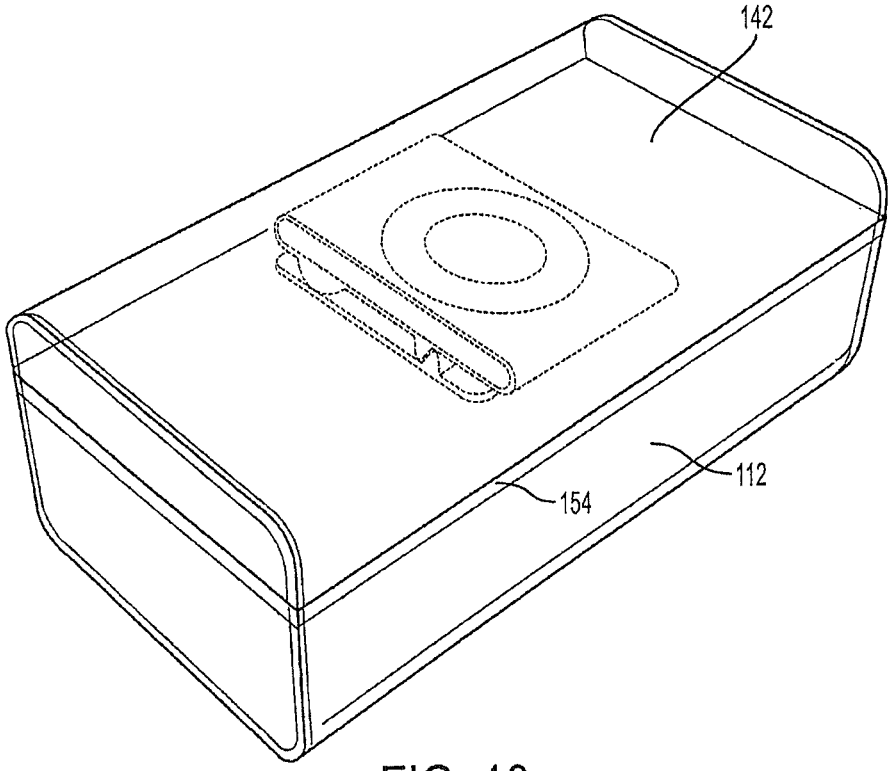
FIG. 10 is a perspective view of the packaging of FIG. 9.
Figure 11:
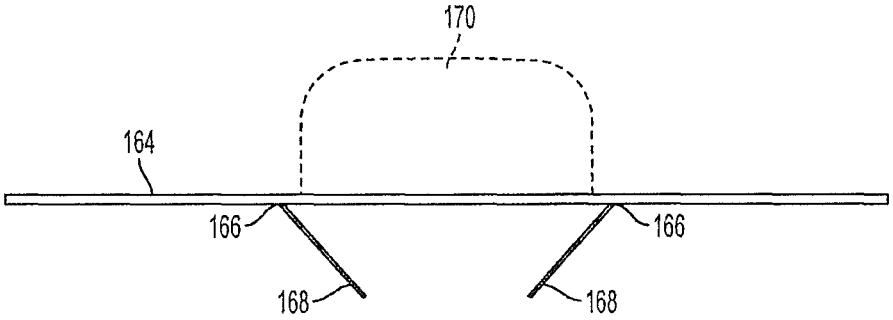
FIG. 11 is a side view of a holder used in the packaging of FIG. 9.

The present invention also comprises another embodiment of packaging, shown generally at 160 in FIGS. 9 and 10, which is comprised of the same base 112, insert 124, and lid 142 as packaging 110; however, packaging 160 includes holder 162 for holding item 170 (shown in phantom in FIGS. 9 and 10). Holder 162 may be generally rectangular in shape and may fit snugly inside of base 112 above insert 124, resting on ledge 114, similar to holder 126. By way of example and not limitation, item 170 may be an iPod® Shuffle® media player, which is a flash MP3 player produced by Apple Inc. It weighs 0.55 ounces and it is 1.07 inches high, 1.62 inches wide, and 0.41 inches deep. Item 170 can vary widely in size, shape, and weight. However, rather than having clips, holder 162 has a pair of slits 166 formed in a horizontal tray portion 164. As seen in FIG. 11, slits 166 accommodate a band 168 which is threaded through slits 166 to form a tab to which item 170 can be clipped, or otherwise attached. As best seen in FIG. 10, once packaging 160 is assembled, item 170 also appears to be "floating" within base 112 and lid 142. Slits 166 can be disposed horizontally on tray 164 as shown or can be disposed vertically. Further, while band 168 is shown threaded through slits 166, it may be looped through slits 166, or it may alternatively extend through slits 166 at each end thereof and then be fastened at each end to the underside of tray 164.

Figure 12:
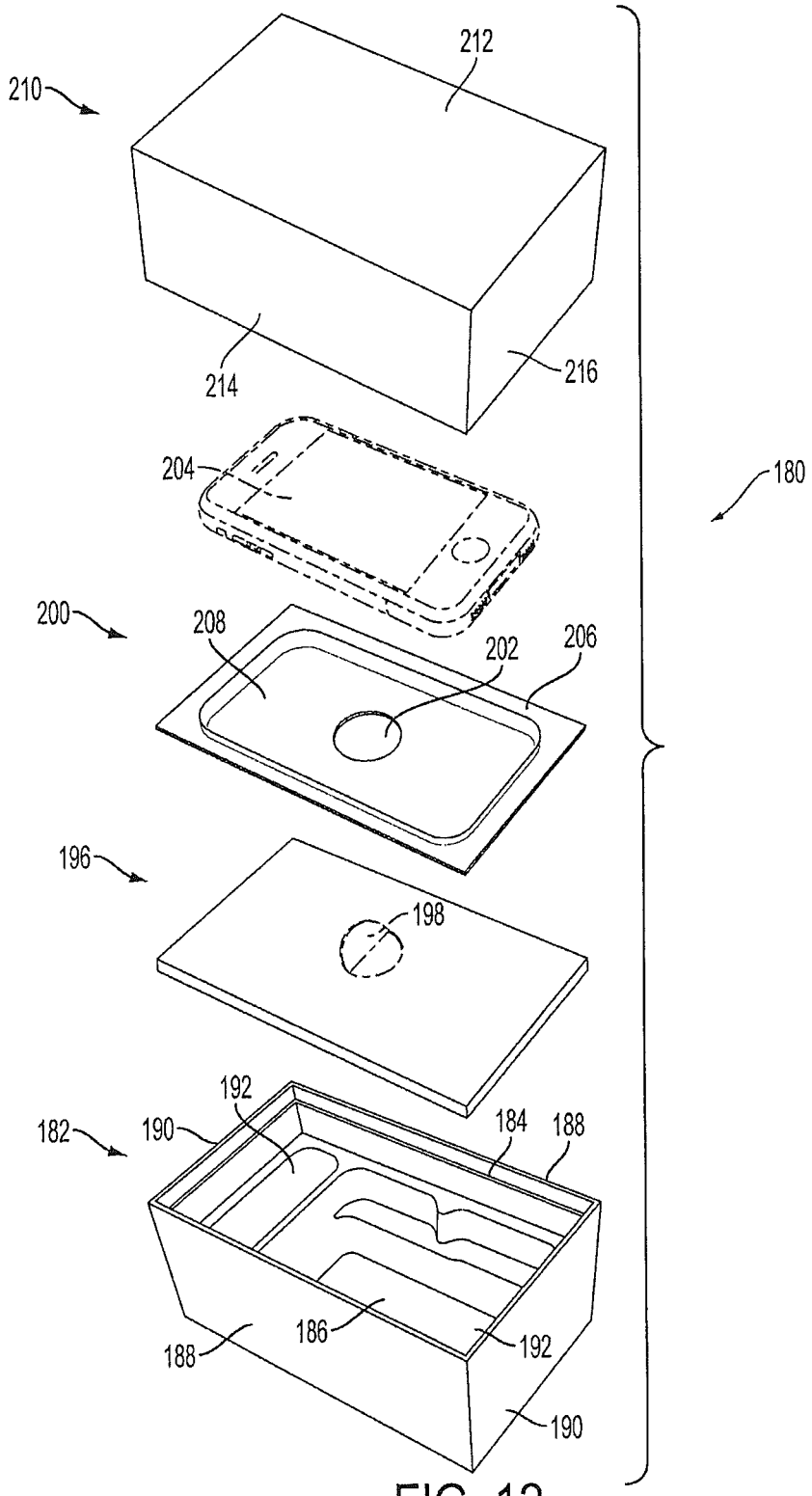
FIG. 12 is an exploded perspective view of another embodiment of packaging according to the present invention.

The present invention also comprises another embodiment of packaging, shown generally at 180 in FIG. 12, which is composed primarily of a base 182, a holder 200, and a lid 210, each of which will now be described in more detail. Base 182 comprises bottom wall 186, two lengthwise parallel vertical side walls 188, and two widthwise parallel vertical side walls 190 joined to bottom wall 186 to create a generally rectangular box shape forming an interior space for receiving an article to be placed in packaging 180. Compartments 192 are formed in base 182 to store accessory items (not shown), for example, power cords, earphones, USB connectors, and the like, or warranties and instruction manuals. A ledge 184 is formed along the interior surface of walls 188 and 190, to support holder 200, as described in more detail below.

A substantially horizontal, planar insert 196 may be placed inside base 182 resting on ledge 184. Insert 196 may be opaque and can be used to conceal accessory items (not shown) which may be stored in compartments 192. Holder 200 rests on top of insert 196 and, can be made of transparent material. In one embodiment, the transparent material is plastic. Insert 196 may include a tab 198 aligned with an opening 202 formed in holder 200. When item 204 (shown in phantom) is removed from packaging 180, the user can grip tab 198 to remove holder 200 and insert 196 in order to have easy access to compartments 192 formed in base 182. While opening 202 and tab 198 are shown as circular, other geometric shapes are possible.

Resting above insert 196, and also supported by ledge 184 is holder 200, which holds item 204 within packaging 180. Holder 200 includes a horizontal tray 206, which can be made of transparent material. In one embodiment, the transparent material is plastic. In one embodiment, holder 200 can be rectangular shaped to fit within the interior space created by walls 188 and 190 of base 182. Holder 200 has an impression 208, which substantially conforms to the shape of item 204, or to whatever item is intended to be contained in impression 208. Not only does this securely hold item 204, but it provides an aesthetically pleasing appearance suggesting that item 204 is "floating" in packaging 180. By way of example and not limitation, item 204 may be an iPhone® smart phone which is described in U.S. patent application Ser. No. 29/281,648 filed Jun. 27, 2007, U.S. patent application No. 29/270,880 filed Jan. 5, 2007, U.S. patent application Ser. No. 29/270,885 filed Jan. 5, 2007, U.S. patent application Ser. No. 29/270,887 filed Jan. 5, 2007, and U.S. patent application Ser. No. 29/270,888 filed Jan. 5, 2007, the disclosures of which are all incorporated in their entirety by reference thereto. The iPhone® smart phone is produced by Apple Inc. It weighs 4.8 ounces, and it is 4.5 inches high, 2.4 inches wide, and 0.46 inches deep. Item 204 can vary widely in size, shape, and weight.

A lid 210 forms the top of packaging 180. Lid 210 has a has a top wall 212 joined along its periphery to two lengthwise parallel vertical walls 214 (only one is shown), and two widthwise parallel vertical walls 216 to form a generally rectangular box shape similar to base 182. Although not shown, a graphical representation of the item contained in packaging 180 may be presented on top wall 212. The width and length of lid 210 are slightly larger than the width and length of base 182 so that lid 210 fits snugly over base 182. While base 182 and lid 210 are shown in the Figures as rectangular shaped, they may be other geometric shapes such as square or round.

As in earlier embodiments, where holder 200 is made of transparent plastic material, and the shape of impression 208 closely conforms to the shape of item 204, item 204 appears to be "floating" in packaging 180. While one impression 208 is shown in the Figures, in an alternative embodiment, multiple impressions 208 may be formed in holder 200 to support multiple items.

Figure 13:
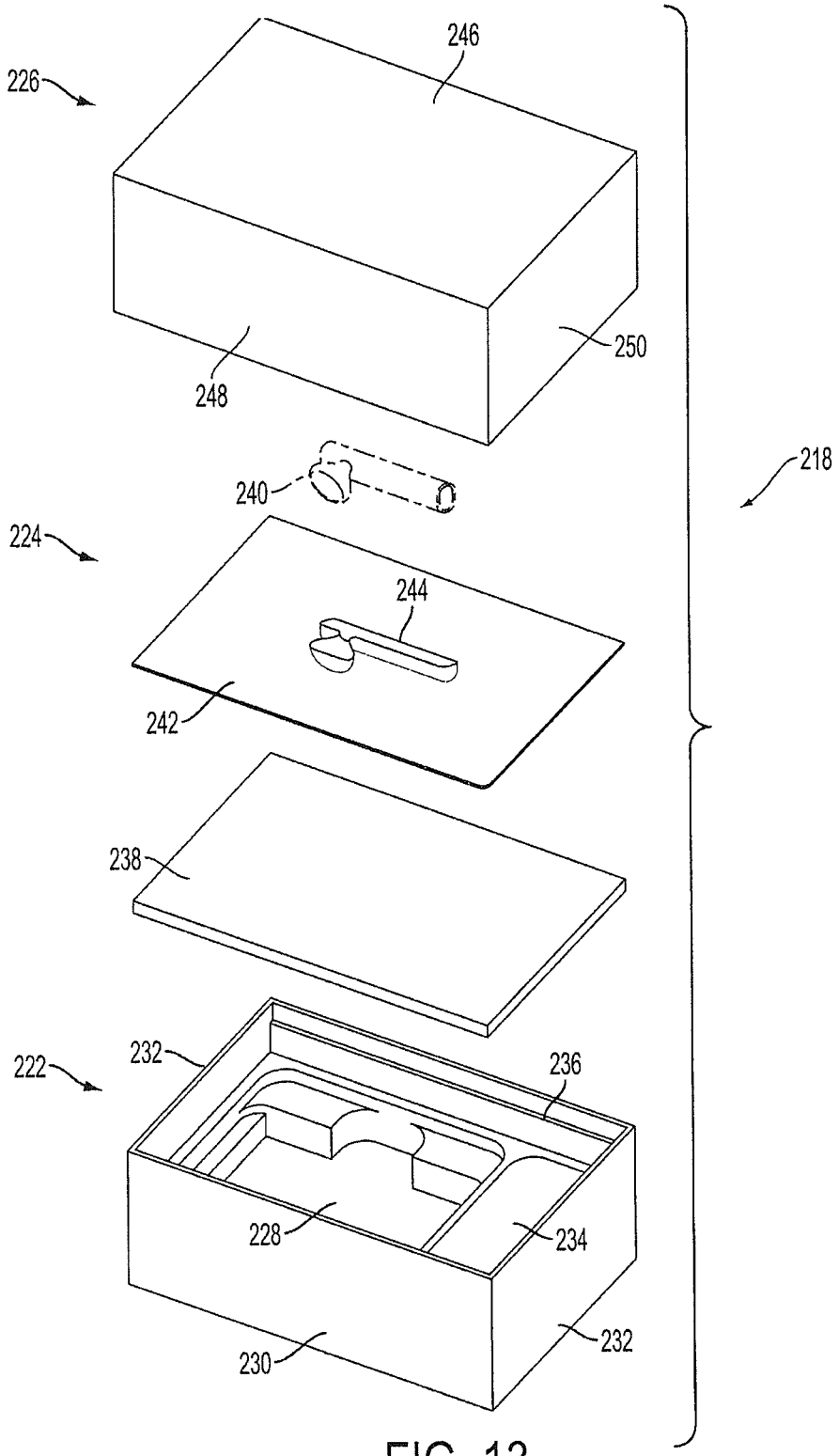
FIG. 13 is an exploded perspective view of another embodiment of packaging according to the present invention.

The present invention also comprises another embodiment of packaging, shown generally at 218 in FIG. 13, which is comprised primarily of a base 222, a holder 224, and a lid 226, each of which will now be described in more detail. Base 222 comprises bottom wall 228, two lengthwise parallel vertical side walls 230, and two widthwise parallel vertical side walls 232 joined to bottom wall 228 to create a generally rectangular box shape. While base 222 is shown to be rectangular shaped, it may alternatively be another geometric shape. Compartments 234 are formed in base 222 to store accessory items (not shown), for example, power cords, earphones, USB connectors, and the like, or warranties and instruction manuals. A ledge 236 is formed along the interior surface of walls 230 and 232 and to support holder 224, as described in more detail below.

A substantially horizontal, planar insert 238 may be placed inside base 222 to separate compartments 234 from the rest of packaging 218. Holder 224 rests on top of insert 238. Holder 224 may be transparent. In one embodiment, the transparent material is plastic. Insert 238 is may be made of opaque material and can be used to conceal accessory items (not shown) which may be stored in compartments 234.

Resting above insert 238, and supported by ledge 236 is holder 224, which holds item 240 (shown in phantom) within packaging 218. Holder 224 includes a horizontal tray 242, which may be transparent. In one embodiment, the transparent material is plastic. Tray 242 may be rectangular shaped to fit within the interior space created by walls 230 and 232 of base 222. Holder 224 has an impression 244, which substantially conforms to the shape of item 240, or to whatever item is intended to be contained in impression 244. By way of example and not limitation, item 240 may be a Bluetooth earpiece for the iPhone® smart phone mentioned above, and described in U.S. patent application Ser. No. 29/270,881, the disclosure of which is incorporated herein in its entirety by reference thereto. Item 240 can vary widely in size, shape, and weight. Not only does packaging 218 securely hold item 240, but it also provides an aesthetically pleasing appearance suggesting that item 240 is "floating" in packaging 218. While only one item is shown contained on holder 224, package 218 may alternatively contain multiple items on holder 224.

Lid 226 comprises a top wall 246, two lengthwise parallel vertical side walls 248 (only one is shown), and two widthwise parallel vertical side walls 250 joined to top wall 246 to create a generally rectangular box shape, similar to base 222. The width and length of lid 226 are slightly larger than the width and length of base 222 so that lid 226 fits snugly over base 222. While base 222 and lid 226 are shown in the Figures as rectangular shaped, they may be other geometric shapes, such as square or round.

While the invention has been described in terms of several preferred embodiments, there are alterations, permutations, and equivalents, which fall with the scope of this invention. For example, the packaging can be used for items other than handheld electronic devices. It is therefore intended that the following appended claims be interpreted as including all such alterations, permutations, and equivalents as fall with the true spirit and scope of the present invention.

We claim:

1. Earpieces with packaging for containing and displaying the earpieces, the earpieces with packaging comprising:

a square-shaped base including a separately closable compartment to store an accessory;

a square-shaped transparent lid disposed on the base in a closed configuration, the lid and base together forming an interior cavity;

earpieces positioned above the compartment within the cavity and visible through the lid; and an opaque holder received and supported by the base, the holder comprising:

a tray; and retaining impressions formed in the tray retaining the earpieces above the compartment such that a speaker portion of the earpiece projects from a surface of the holder.

2. An earpiece with packaging for containing and displaying the earpiece, the earpiece with packaging comprising:

a base;

a lid disposed on the base, the lid and base together forming an interior cavity, wherein the lid has a transparent portion;

an earpiece disposed within the cavity and visible through the transparent portion; and an earpiece holder supported by the base, the earpiece holder comprising:

a tray; and a retaining mechanism in the form of an impression in the tray, wherein the impression includes an elongated portion extending from a wider portion to conform to a shape of the earpiece such that the impression retains the earpiece in position within the packaging such that the earpiece protrudes from the impression.

3. The earpiece and packaging of claim 2, wherein the earpiece includes an elongate portion disposed below a plane defined by the top surface of the holder and wholly within the elongated portion of the impression.

4. The earpiece and packaging of claim 2, wherein edges of the base and lid close to form an outer perimeter of the packaging.

5. The earpiece and packaging of claim 2, wherein the packaging is square-shaped with rounded corners.

6. A system including an earpiece and packaging for containing and displaying the earpiece, the system comprising:

a packaging container with a transparent lid;

an earpiece holder within the packaging container, wherein the earpiece holder is a tray with an earpiece-shaped impression therein; and an earpiece at least partially disposed in a profile orientation within the impression of the tray and at least partially disposed above the tray in a space between the tray and the lid such that the earpiece is visible through the lid.

7. The system of claim 6, wherein the packaging container is an outer shell comprising:

the transparent lid, wherein the lid forms an internal lid cavity and has a lower lid edge extending around its periphery; and a base forming an internal base cavity and having an upper base edge extending around its periphery, wherein the lower lid edge and the upper base edge meet to close the package.

8. The system of claim 7, wherein the base is transparent.

9. The system of claim 7, wherein the earpiece holder is received within the internal base cavity.

10. The system of claim 7, wherein the base further comprises an internal compartment configured to store accessory items.

11. The system of claim 10, further comprising an insert separating the earpiece holder from the compartment.

12. The system of claim 6, wherein the earpiece holder is opaque.

13. The system of claim 6, wherein the impression includes a first portion extending a first depth to receive a first portion of the earpiece and a second portion extending a second depth greater than the first depth to receive a second portion of the earpiece.

14. The system of claim 6, wherein the earpiece comprises an elongate member and a rounded member protruding from a side of the elongate member and configured to be inserted into an ear.

15. The system of claim 6, wherein the lid is square-shaped with curved upper edges.

16. The system of claim 6, wherein the packaging container is square-shaped having curved upper edges on its lid and corresponding curved lower edges on its base.

17. The system of claim 6, wherein the earpiece comprises a rounded member disposed within the impression of the tray.

18. The system of claim 17, wherein the earpiece further comprises an elongate member disposed within the impression of the tray at a first depth less than a second depth at which the rounded member is disposed within the impression, the elongate member disposed below a plane defined by the top surface of the tray.

19. The earpieces with packaging of claim 1, wherein the opaque holder is removable from the base.

* * * * *